US009626987B2

(12) United States Patent
Matsuo

(10) Patent No.: US 9,626,987 B2
(45) Date of Patent: Apr. 18, 2017

(54) SPEECH ENHANCEMENT APPARATUS AND SPEECH ENHANCEMENT METHOD

(71) Applicant: FUJITSU LIMITED, Kawasaki-shi, Kanagawa (JP)

(72) Inventor: Naoshi Matsuo, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 260 days.

(21) Appl. No.: 14/072,937

(22) Filed: Nov. 6, 2013

(65) Prior Publication Data

US 2014/0149111 A1 May 29, 2014

(30) Foreign Application Priority Data

Nov. 29, 2012 (JP) ..... 2012-261704

(51) Int. Cl.
*G10L 21/00* (2013.01)
*G10L 21/0232* (2013.01)
*G10L 21/0316* (2013.01)

(52) U.S. Cl.
CPC ..... *G10L 21/0232* (2013.01); *G10L 21/0316* (2013.01)

(58) Field of Classification Search
CPC . G10L 21/02; G10L 21/0202; G10L 21/0205; G10L 21/0208; G10L 21/0216;
(Continued)

(56) References Cited

U.S. PATENT DOCUMENTS 5,228,088 A 7/1993 Kane et al.
6,233,549 B1 * 5/2001 Mauro et al. ..... 704/207
(Continued)

FOREIGN PATENT DOCUMENTS

EP 2333771 A1 6/2011
JP 4-227338 8/1992
(Continued)

OTHER PUBLICATIONS

EESR—Extended European Search Report of European Patent Application No. 13190939.2 dated Aug. 7, 2015.
(Continued)

*Primary Examiner* — Paras D Shah
(74) *Attorney, Agent, or Firm* — Fujitsu Patent Center

(57) ABSTRACT

A speech enhancement apparatus includes: a noise estimating unit which estimates a noise component contained in a speech signal for each frequency band; a signal-to-noise ratio computing unit which computes, for each frequency band, a signal-to-noise ratio; a gain computing unit which selects a frequency band whose computed signal-to-noise ratio indicates that the signal component contained in the speech signal for the frequency band is recognizable, and which determines a gain indicating the degree of enhancement to be applied to the speech signal in accordance with the signal-to-noise ratio of the selected frequency band; and an enhancing unit which amplifies an amplitude component of a frequency domain signal in each frequency band in accordance with the gain, and which corrects the amplitude component of the frequency domain signal by subtracting the noise component from the amplitude component in each frequency band.

11 Claims, 10 Drawing Sheets

(58) Field of Classification Search

CPC ..... G10L 21/0232; G10L 21/0316; G10L 21/0324; G10L 21/0332; G10L 21/0364; G10L 2021/0208; G10L 2021/0216; G10L 2021/02161; G10L 2021/02163; G10L 2021/0316; G10L 2021/0364; G10K 2210/00; G10K 2210/108; G10K 2210/301; G10K 2210/3011; G10K 2210/3012; G10K 2210/3023

USPC ..... 704/200, 226, 227, 228, 205, 208, 210; 381/71.1, 94.1, 94.2, 94.3

See application file for complete search history.

(56) References Cited

U.S. PATENT DOCUMENTS

| | | | | |
|---|---|---|---|---|
| 6,804,640 | B1 * | 10/2004 | Weintraub et al. | 704/226 |
| 7,058,572 | B1 * | 6/2006 | Nemer | 704/226 |
| 7,885,810 | B1 * | 2/2011 | Wang | 704/225 |
| 2002/0156623 | A1 * | 10/2002 | Yoshida | 704/226 |
| 2003/0078772 | A1 * | 4/2003 | Wu et al. | 704/226 |
| 2004/0186711 | A1 * | 9/2004 | Frank et al. | 704/226 |
| 2006/0184363 | A1 * | 8/2006 | McCree et al. | 704/233 |
| 2006/0241938 | A1 * | 10/2006 | Hetherington et al. | 704/208 |
| 2006/0271362 | A1 * | 11/2006 | Katou et al. | 704/233 |
| 2007/0232257 | A1 * | 10/2007 | Otani | G10L 21/0208 455/403 |
| 2008/0075300 | A1 * | 3/2008 | Isaka | 381/94.2 |
| 2008/0219471 | A1 * | 9/2008 | Sugiyama et al. | 381/94.2 |
| 2008/0219472 | A1 * | 9/2008 | Chhatwal et al. | 381/94.3 |
| 2008/0304673 | A1 | 12/2008 | Otani | |
| 2008/0304679 | A1 * | 12/2008 | Schmidt | G10L 21/0208 381/94.2 |
| 2011/0081026 | A1 * | 4/2011 | Ramakrishnan et al. | 381/94.3 |
| 2011/0082692 | A1 * | 4/2011 | Lim et al. | 704/225 |
| 2011/0125494 | A1 * | 5/2011 | Alves et al. | 704/226 |
| 2011/0142256 | A1 * | 6/2011 | Lee | G10L 21/0208 381/94.3 |
| 2012/0057711 | A1 * | 3/2012 | Makino et al. | 381/57 |
| 2013/0028440 | A1 * | 1/2013 | Perkmann et al. | 381/94.1 |
| 2013/0054234 | A1 * | 2/2013 | Kim et al. | 704/226 |

FOREIGN PATENT DOCUMENTS

| | | |
|---|---|---|
| JP | 2979714 B2 | 11/1999 |
| JP | 2008-306630 | 12/2008 |
| JP | 2010-54954 | 3/2010 |
| WO | 2009/035614 A1 | 3/2009 |

OTHER PUBLICATIONS

JPOA—Office Action of Japanese Patent Application No. 2012-261704 mailed Aug. 30, 2016, with English translation.

* cited by examiner

SPEECH ENHANCEMENT APPARATUS AND SPEECH ENHANCEMENT METHOD

CROSS-REFERENCE TO RELATED APPLICATION

This application is based upon and claims the benefit of priority of the prior Japanese Patent Application No. 2012-261704, filed on Nov. 29, 2012, the entire contents of which are incorporated herein by reference.

FIELD

The embodiments discussed herein are related to a speech enhancement apparatus and speech enhancement method for enhancing a desired signal component contained in a speech signal.

BACKGROUND

Speech captured by a microphone may contain a noise component. If the captured speech contains a noise component, intelligibility of the speech may be reduced. In view of this, techniques have been developed for suppressing noise by estimating the noise component contained in the speech signal for each frequency band and by subtracting the estimated noise component from the amplitude spectrum of the speech signal (for example, refer to Japanese Laid-open Patent Publication Nos. H04-227338 and 2010-54954).

However, if, for example, a vehicle driver's speech is to be captured by a microphone mounted in a vehicle while the driver is driving with vehicle windows left open, the noise component contained in the speech signal may becomes larger than the signal component corresponding to the speech intended to be captured. In such cases, any of the above prior art techniques may suppress not only the noise component but also the signal component, resulting in reduced intelligibility of the intended speech.

SUMMARY

According to one embodiment, a speech enhancement apparatus is provided. The speech enhancement apparatus includes a time-frequency transforming unit which computes a frequency domain signal for each of a plurality of frequency bands by transforming a speech signal containing a signal component and a noise component into a frequency domain; a noise estimating unit which estimates the noise component based on the frequency domain signal for each frequency band; a signal-to-noise ratio computing unit which computes, for each frequency band, a signal-to-noise ratio representing the ratio of the signal component to the noise component; a gain computing unit which selects a frequency band whose computed signal-to-noise ratio indicates that the signal component contained in the speech signal for the frequency band is recognizable, and which determines a gain indicating the degree of enhancement to be applied to the speech signal in accordance with the signal-to-noise ratio of the selected frequency band; an enhancing unit which amplifies an amplitude component of the frequency domain signal in each frequency band in accordance with the gain, and which corrects the amplitude component of the frequency domain signal by subtracting the noise component from the amplitude component in each frequency band; and a frequency-time transforming unit which computes a corrected speech signal by transforming the frequency domain signal having the corrected amplitude component in each frequency band into a time domain.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Speech enhancement apparatus according to various embodiments will be described below with reference to the drawings.

The speech enhancement apparatus estimates signal-to-noise ratio for each frequency band of a speech signal containing a signal component corresponding to the speech to be captured and a noise component corresponding to sound other than the intended speech and, based on the estimated signal-to-noise ratio, selects a frequency band in which the signal component is recognizable. Then, based on the signal-to-noise ratio of the selected frequency band, the speech enhancement apparatus determines a gain that indicates the degree of enhancement to be applied to the signal component. The speech enhancement apparatus then amplifies the amplitude spectrum of the speech signal over the entire range of frequency bands in accordance with the gain, and subtracts the noise component from the amplified amplitude spectrum.

Figure 1:
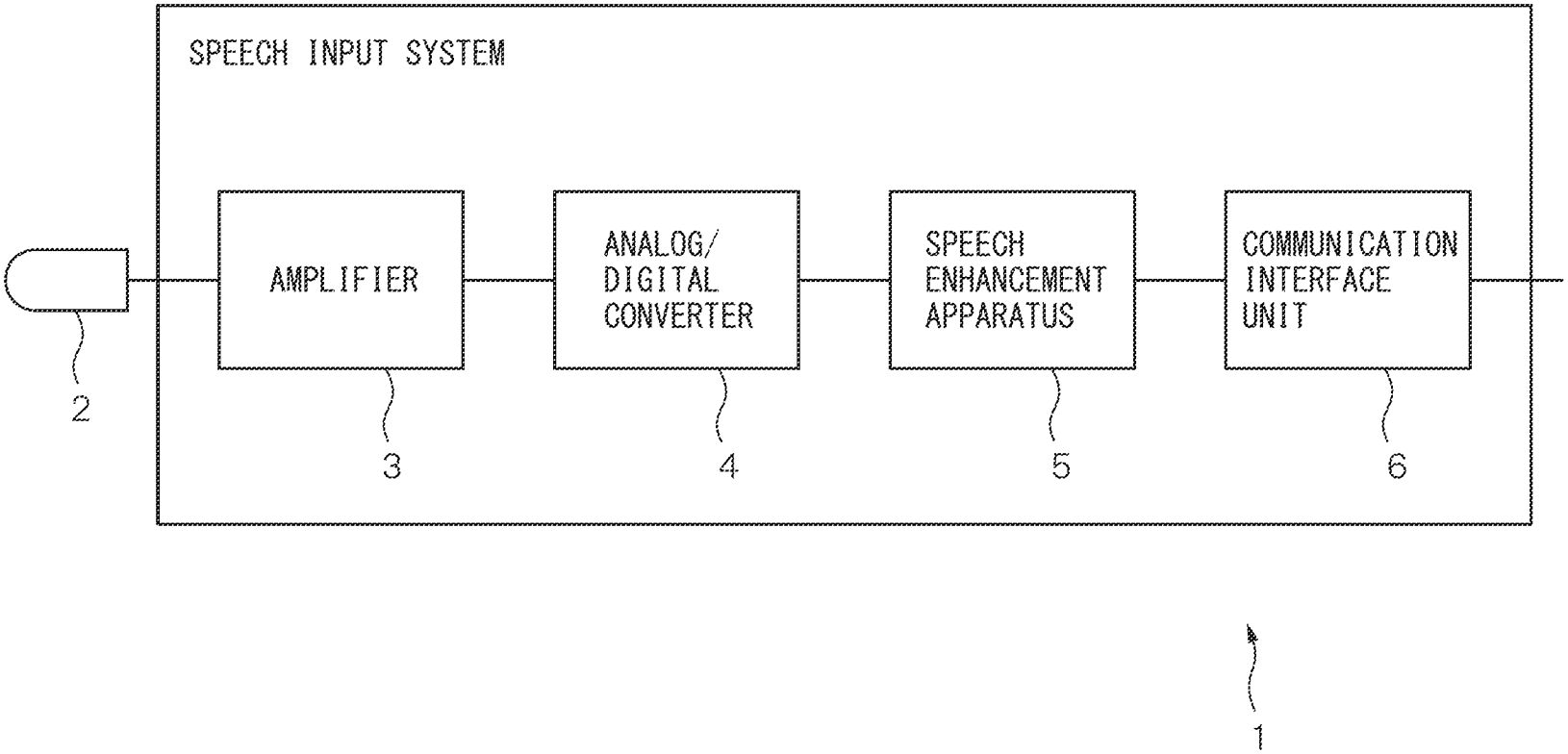
FIG. 1 is a diagram schematically illustrating the configuration of a speech input system equipped with a speech enhancement apparatus according to one embodiment.

FIG. 1 is a diagram schematically illustrating the configuration of a speech input system equipped with a speech enhancement apparatus according to one embodiment. In the present embodiment, the speech input system 1 is, for example, a vehicle-mounted hands-free phone, and includes, in addition to the speech enhancement apparatus 5, a microphone 2, an amplifier 3, an analog/digital converter 4, and a communication interface unit 6.

The microphone 2 is one example of a speech input unit, which captures sound in the vicinity of the speech input system 1, generates an analog speech signal proportional to the intensity of the sound, and supplies the analog speech signal to the amplifier 3. The amplifier 3 amplifies the analog speech signal, and supplies the amplified analog speech signal to the analog/digital converter 4. The analog/digital converter 4 produces a digitized speech signal by sampling the amplified analog speech signal at a predetermined sampling frequency. The analog/digital converter 4 passes the digitized speech signal to the speech enhancement apparatus 5. The digitized speech signal will hereinafter be referred to simply as the speech signal.

The speech signal contains a signal component intended to be captured, for example, the voice of the user using the speech input system 1, and a noise component such as background noise. Therefore, the speech enhancement apparatus 5 includes, for example, a digital signal processor, and generates a corrected speech signal by suppressing the noise component while enhancing the intended signal component contained in the speech signal. The speech enhancement apparatus 5 passes the corrected speech signal to the communication interface unit 6.

The communication interface unit 6 includes a communication interface circuit for connecting the speech input system 1 to another apparatus such as a mobile telephone. The communication interface circuit may be, for example, a circuit that operates in accordance with a short-distance wireless communication standard, such as Bluetooth (registered trademark), that can be used for speech signal communication, or a circuit that operates in accordance with a serial bus standard such as Universal Serial Bus (USB). The corrected speech signal from the speech enhancement apparatus 5 is transmitted out via the communication interface unit 6 to another apparatus.

Figure 2:
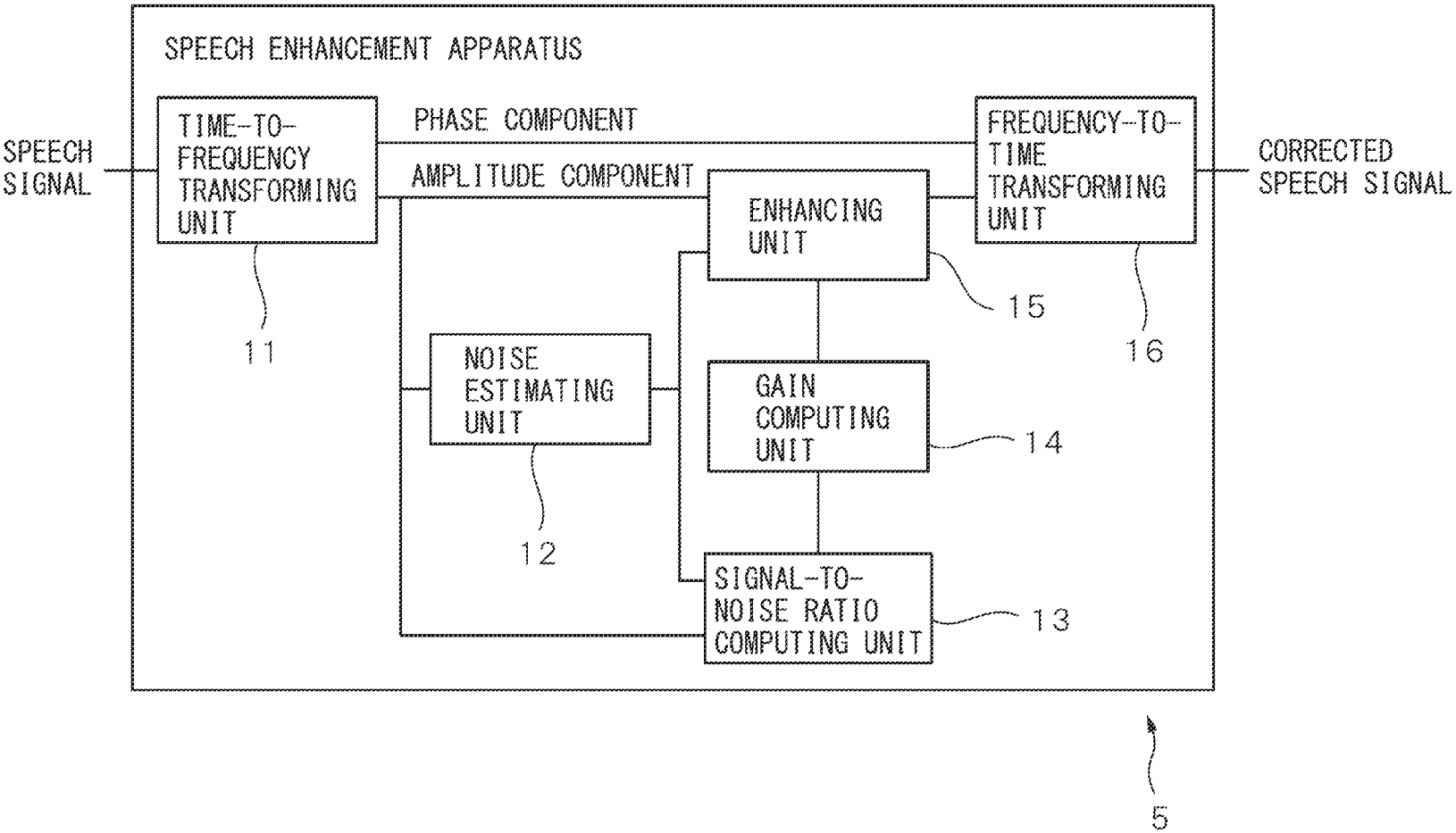
FIG. 2 is a diagram schematically illustrating the configuration of the speech enhancement apparatus.

FIG. 2 is a diagram schematically illustrating the configuration of the speech enhancement apparatus 5. The speech enhancement apparatus 5 includes a time-to-frequency transforming unit 11, a noise estimating unit 12, a signal-to-noise ratio computing unit 13, a gain computing unit 14, an enhancing unit 15, and a frequency-to-time transforming unit 16. These units constituting the speech enhancement apparatus 5 are functional modules implemented, for example, by executing a computer program on the digital signal processor.

The time-to-frequency transforming unit 11 obtains a frequency domain signal for each of a plurality of frequency bands by transforming the speech signal into the frequency domain on a frame-by-frame basis, each frame having a predefined time length (for example, tens of milliseconds). For this purpose, the time-to-frequency transforming unit 11 applies a time-to-frequency transform, such as a fast Fourier transform (FFT) or a modified discrete cosine transform (MDCT), to the speech signal for transformation into the frequency domain.

In the present embodiment, the time-to-frequency transforming unit 11 sets the frames of the speech signal so that any two successive frames are shifted relative to each other by one half of the frame length. Then, the time-to-frequency transforming unit 11 multiplies each frame by a windowing function such as a Hamming window, and transforms the frame into the frequency domain to compute the frequency domain signal in each frequency band for that frame.

The time-to-frequency transforming unit 11 passes the amplitude component of the frequency domain signal on a frame-by-frame basis to the noise estimating unit 12, the signal-to-noise ratio computing unit 13, and the enhancing unit 15. Further, the time-to-frequency transforming unit 11 passes the phase component of the frequency domain signal to the frequency-to-time transforming unit 16.

The noise estimating unit 12 estimates the noise component for each frequency band in the current frame which is the most recent frame, by updating, based on the amplitude spectrum of the current frame, the noise model representing the noise component for each frequency band estimated based on a predetermined number of past frames.

More specifically, each time the amplitude component of the frequency domain signal in each frequency band is received from the time-to-frequency transforming unit 11, the noise estimating unit 12 computes an average value p of the amplitude spectrum in accordance with the following equation.

$$p = \frac{1}{N}\sum_{f=flow}^{fhigh} 10\log_{10}(S(f)^2) \tag{1}$$

where N represents the total number of frequency bands which is one half of the number of samples contained in one frame in the time-to-frequency transform. Further, $f_{low}$ represents the lowest frequency band, while $f_{high}$ represents the highest frequency band. On the other hand, S(f) is the amplitude component of the current frame in frequency band f, and $10\log_{10}(S(f)^2)$ is a logarithmic representation of the amplitude spectrum.

Next, the noise estimating unit 12 compares the average value p of the amplitude spectrum of the current frame with a threshold value Thr that defines the upper limit of the noise component. When the average value p is smaller than the threshold value Thr, the noise estimating unit 12 updates the noise model by averaging the amplitude spectra and noise components in the past frames in accordance with the following equation for each frequency band.

$$N_t(f)=(1-\alpha)\cdot N_{t-1}(f)+\alpha\cdot 10\log_{10}(S(f)^2) \tag{2}$$

where $N_{t-1}(f)$ is the noise component in frequency band f contained in the noise model before updating, and is read out of a buffer in the digital signal processor contained in the speech enhancement apparatus 5. On the other hand, $N_t(f)$ is the noise component in frequency band f contained in the updated noise model. Factor $\alpha$ is a forgetting factor which is set to a value within a range of 0.01 to 0.1. On the other hand, when the average value p is not smaller than the threshold value Thr, it can be deduced that a signal component other than noise is contained in the current frame;

therefore, the noise estimating unit 12 takes the current noise model directly as the updated noise model by setting the forgetting factor α to 0. In other words, the noise estimating unit 12 does not update the noise model, and sets $N_t(f)=N_{t-1}(f)$ for all frequency bands. Alternatively, when a signal component other than noise is contained in the current frame, the noise estimating unit 12 may minimize the effect of the current frame on the noise model by setting the forgetting factor α to a very small value, for example, to 0.0001.

The noise estimating unit 12 may estimate the noise component for each frequency band by using any one of various other methods for estimating the noise component for each frequency band. The noise estimating unit 12 stores the updated noise model in a buffer, and passes the noise component in each frequency band to the signal-to-noise ratio computing unit 13 and the enhancing unit 15.

The signal-to-noise ratio computing unit 13 computes the signal-to-noise ratio (SNR) for each frequency band on a frame-by-frame basis. In the present embodiment, the signal-to-noise ratio computing unit 13 computes SNR for each frequency band in accordance with the following equation.

$$\mathrm{SNR}(f)=10\log_{10}(S(f)^2)-N_t(f) \tag{3}$$

where SNR(f) represents the SNR in frequency band f. On the other hand, S(f) is the amplitude component of the frequency domain signal in frequency band f in the current frame, while $N_t(f)$ is the amplitude component of noise in frequency band f in the current frame.

The signal-to-noise ratio computing unit 13 passes the SNR(f) computed for each frequency band to the gain computing unit 14.

Based on the SNR(f) computed for each frequency band, the gain computing unit 14 determines, on a frame-by-frame basis, the gain g to be applied over the entire range of frequency bands. For this purpose, the gain computing unit 14 selects a band whose SNR(f) is not smaller than a predetermined threshold value. The threshold value is set to a minimum value of SNR(f), for example, 3 dB, below which humans can no longer recognize the signal component contained in the speech signal.

The gain computing unit 14 computes an average value SNRav of the SNR(f) of the selected frequency band. Then, based on the average value SNRav of SNR(f), the gain computing unit 14 determines the gain g to be applied to all the frequency bands.

Figure 3:
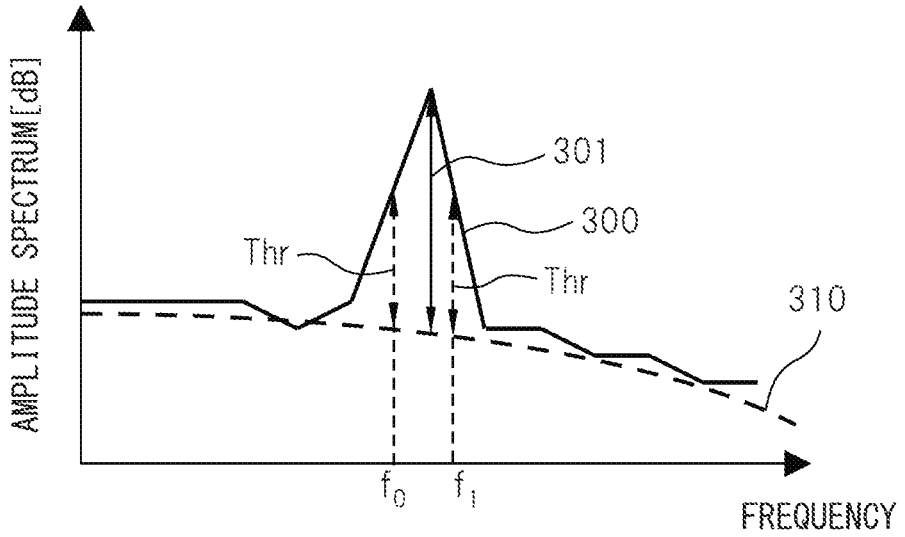
FIG. 3 is a diagram illustrating one example of the relationship between the amplitude spectrum and noise spectrum of a speech signal and the frequency band used for computing a gain.

FIG. 3 is a diagram illustrating one example of the relationship between the amplitude spectrum and noise spectrum of the speech signal and the frequency band used for computing the gain. In FIG. 3, the abscissa represents the frequency, and the ordinate represents the intensity [dB] of the amplitude spectrum. Graph 300 depicts the amplitude spectrum of the speech signal, while graph 310 depicts the amplitude spectrum of the noise component. In FIG. 3, the difference between the amplitude spectrum of the speech signal and the amplitude spectrum of the noise component, indicated by arrow 301, corresponds to SNR(f). In the illustrated example, SNR(f) lies above the threshold value Thr in the frequency band of $f_0$ to $f_1$. Therefore, the frequency band of $f_0$ to $f_1$ is selected as the frequency band for determining the gain g.

Figure 4:
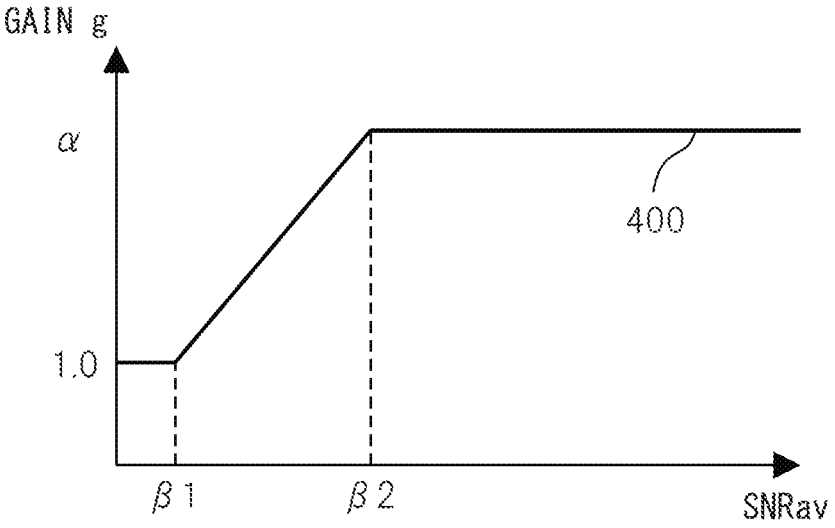
FIG. 4 is a diagram illustrating one example of the relationship between the average value SNRav of SNR(f) and the gain g.

FIG. 4 is a diagram illustrating one example of the relationship between the average value SNRav of SNR(f) and the gain g. In FIG. 4, the abscissa represents the average value SNRav [dB], and the ordinate represents the gain g. Graph 400 depicts the gain g as a function of the average value SNRav. As depicted by the graph 400, when the average value SNRav is not larger than β1, the gain computing unit 14 sets the gain g to 1.0. In other words, no enhancement is applied to the speech signal. On the other hand, when the average value SNRav is larger than β1 but not larger than β2, the gain computing unit 14 increases the gain g linearly as the average value SNRav increases. When the average value SNRav is equal to or larger than β2, the gain computing unit 14 sets the gain g to its upper limit value α.

The values β1, β2, and α are empirically determined so that the corrected speech signal will not be distorted unnaturally; for example, β1=6 [dB], and β2=9 [dB]. The upper limit value α of the gain g is, for example, 2.0.

The gain computing unit 14 passes the gain g to the enhancing unit 15.

The enhancing unit 15 suppresses the noise component, while enhancing the amplitude component of the frequency domain signal in each frequency band in accordance with the gain g on a frame-by-frame basis. In the present embodiment, the enhancing unit 15 enhances the amplitude component of the frequency domain signal in each frequency band in accordance with the following equation.

$$\begin{aligned}10\log_{10}(S'(f)^2) &= 10\log_{10}(S(f)^2)+10\log_{10}g \\ &= 10\log_{10}(g\cdot S(f)^2)\end{aligned} \tag{4}$$

where $S'(f)^2$ represents the power spectrum of frequency band f after amplification.

Further, the enhancing unit 15 computes the corrected amplitude component $S_c(f)$ of the frequency domain signal in each frequency band by subtracting the noise component from the amplified power spectrum $S'(f)^2$ in accordance with the following equation. The enhancing unit 15 can thus suppress the noise component contained in the speech signal.

$$S_c(f)^2=S'(f)^2-n(f)$$

$$N(f)=10\log_{10}(n(f)) \tag{5}$$

where n(f) represents the power spectrum of the noise component expressed in a linear numerical value.

Figure 5A:
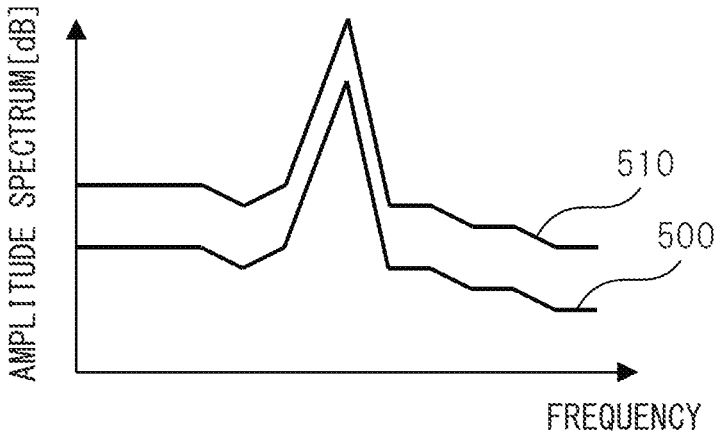
FIG. 5A is a diagram illustrating one example of the relationship between the amplitude spectrum of the original speech signal and the amplitude spectrum amplified using the gain.
Figure 5B:
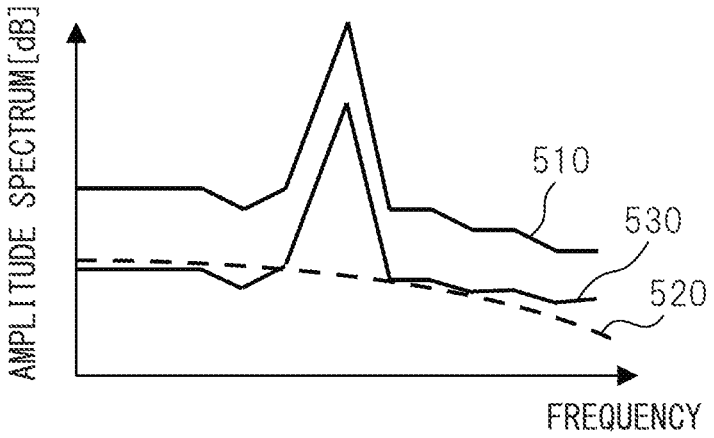
FIG. 5B is a diagram illustrating one example of the relationship between the amplified amplitude spectrum, the noise component, and the amplitude spectrum obtained after suppressing the noise component.

FIG. 5A is a diagram illustrating one example of the relationship between the amplitude spectrum of the original speech signal and the amplitude spectrum amplified using the gain. FIG. 5B is a diagram illustrating one example of the relationship between the amplified amplitude spectrum, the amplitude spectrum of the noise component, and the amplitude spectrum obtained after suppressing the noise component. In FIGS. 5A and 5B, the abscissa represents the frequency, and the ordinate represents the intensity [dB] of the amplitude spectrum. In FIG. 5A, graph 500 depicts the amplitude spectrum of the original speech signal, and graph 510 depicts the amplified amplitude spectrum. In the present embodiment, as can be seen from the graphs 500 and 510, the amplitude spectrum is amplified over the entire frequency range, including not only the frequency band used for computing the gain but also other frequency bands.

In FIG. 5B, graph 510 depicts the amplified amplitude spectrum, and graph 520 depicts the amplitude spectrum of the noise component. On the other hand, graph 530 depicts the amplitude spectrum of the corrected speech signal obtained by subtracting the amplitude spectrum of the noise component from the amplified amplitude spectrum. In the present embodiment, as can be seen from the graphs 510 to 530, the noise component is subtracted after amplifying the amplitude spectrum over the entire frequency range. As a result, the corrected speech signal retains the signal component even in frequency bands where the power of the signal component is low in the original speech signal.

The enhancing unit 15 passes the corrected amplitude component $S_c(f)$ of the frequency domain signal in each frequency band to the frequency-to-time transforming unit 16.

The frequency-to-time transforming unit 16 computes the corrected frequency spectrum on a frame-by-frame basis by multiplying the corrected amplitude component $S_c(f)$ of the frequency domain signal in each frequency band by the phase component of that frequency band. Then, the frequency-to-time transforming unit 16 applies a frequency-to-time transform for transforming the corrected frequency spectrum into a time domain signal, to obtain a frame-by-frame corrected speech signal. This frequency-to-time transform is the inverse transform of the time-to-frequency transform performed by the time-to-frequency transforming unit 11. Lastly, the frequency-to-time transforming unit 16 obtains the corrected speech signal by successively adding up the frame-by-frame corrected speech signals with one shifted from another by one half of the frame length.

Figure 6A:
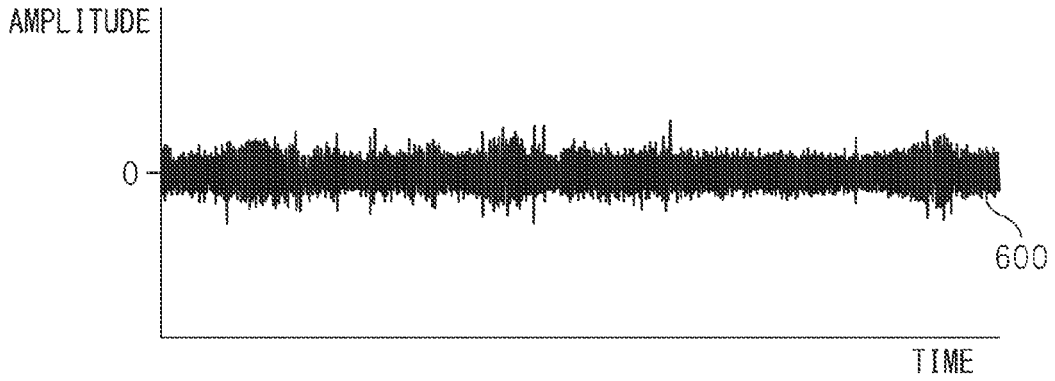
FIG. 6A is a diagram illustrating one example of the signal waveform of the original speech signal.
Figure 6B:
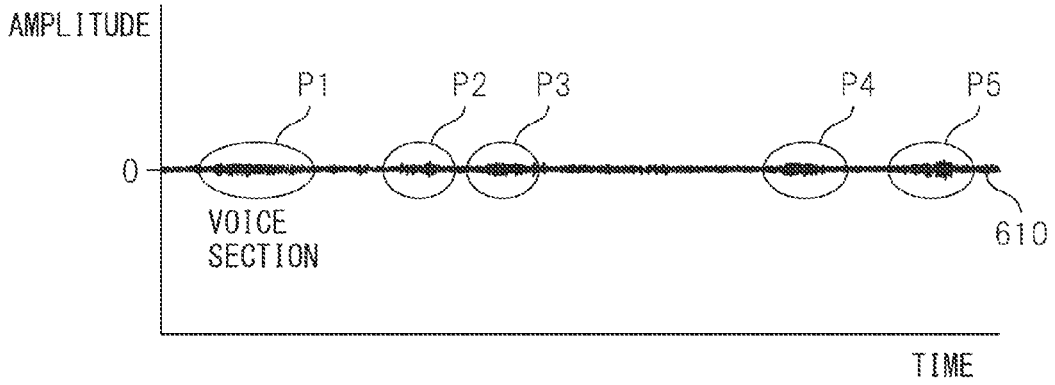
FIG. 6B is a diagram illustrating one example of the signal waveform of the speech signal corrected according to the prior art.
Figure 6C:
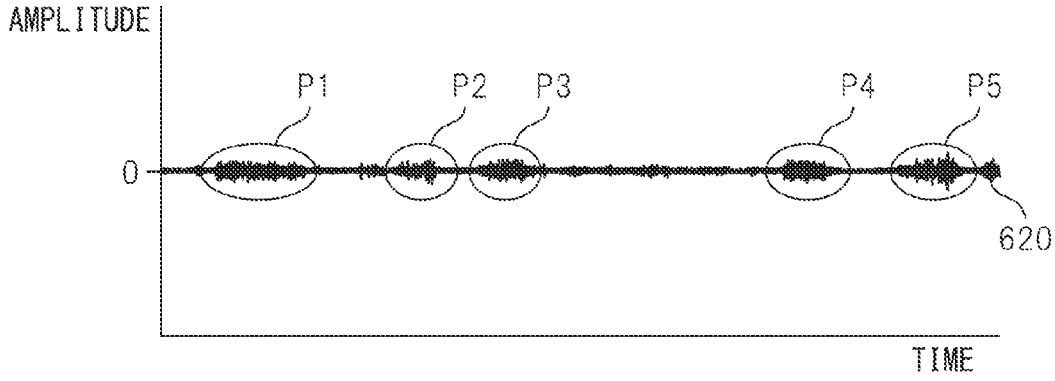
FIG. 6C is a diagram illustrating one example of the signal waveform of the speech signal corrected by the speech enhancement apparatus according to the present embodiment.

FIG. 6A is a diagram illustrating one example of the signal waveform of the original speech signal. FIG. 6B is a diagram illustrating one example of the signal waveform of the speech signal corrected according to the prior art. FIG. 6C is a diagram illustrating one example of the signal waveform of the speech signal corrected by the speech enhancement apparatus according to the present embodiment.

In FIGS. 6A to 6C, the abscissa represents the time, and the ordinate represents the intensity of the amplitude of the speech signal. Signal waveform 610 is the signal waveform of the speech signal generated by simply removing the estimated noise component from the original speech signal in accordance with the prior art. On the other hand, signal waveform 620 is the signal waveform of the speech signal corrected by the speech enhancement apparatus 5 according to the present embodiment. In the illustrated example, the signal component is contained in each of the periods p1 to p5. However, in the prior art, as depicted by the signal waveform 610, the signal component contained in any of the periods p1 to p5 is greatly attenuated, thus causing breaks in the speech signal. On the other hand, according to the present embodiment, compared with the speech signal corrected by the prior art, the signal component is substantially retained in the speech signal, thus preventing breaks from being caused in the speech signal.

Figure 7:
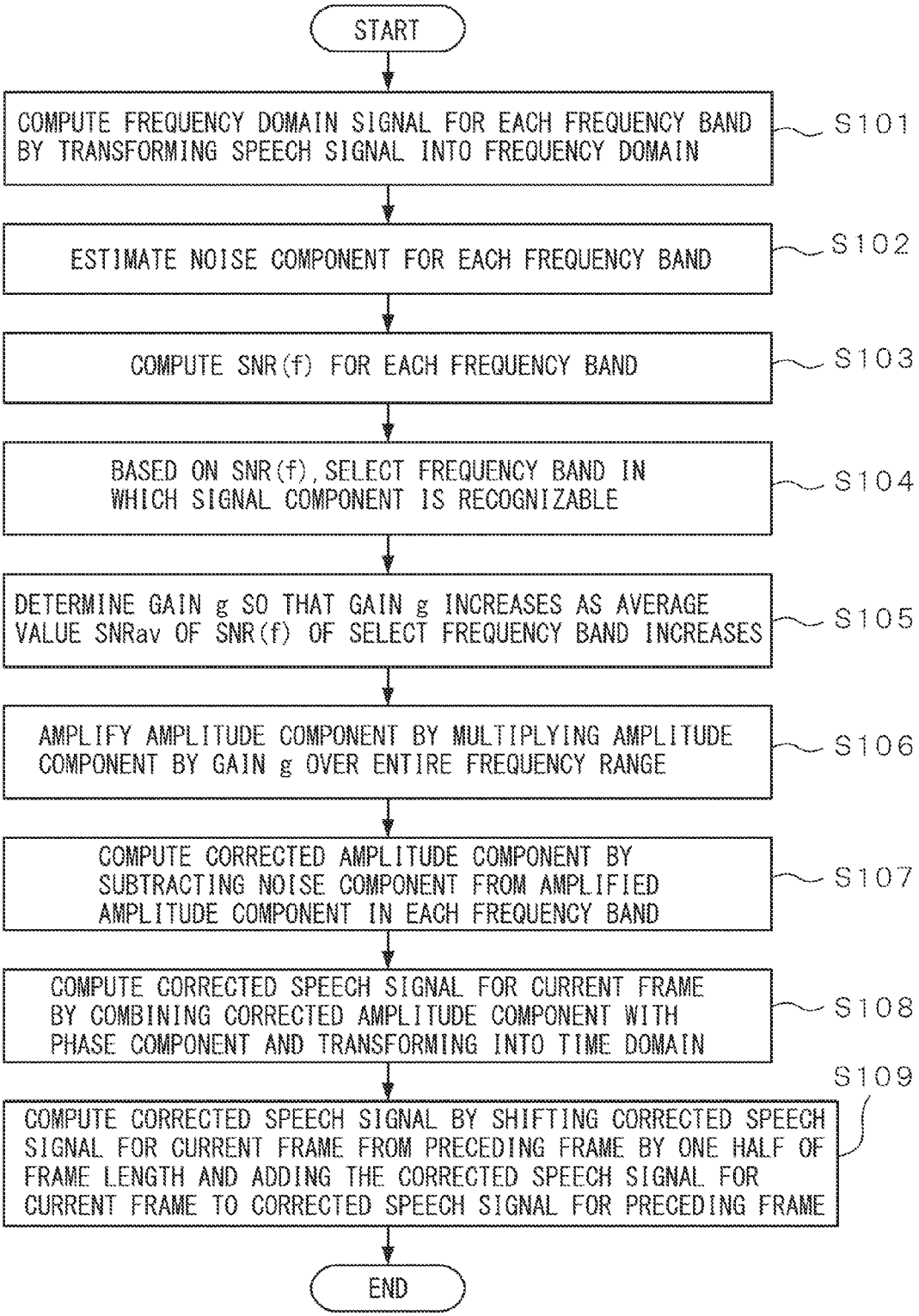
FIG. 7 is an operation flowchart illustrating a speech enhancing process.

FIG. 7 is an operation flowchart illustrating a speech enhancing process. The speech enhancement apparatus 5 carries out the speech enhancing process on a frame-by-frame basis in accordance with the following operation flowchart.

The time-to-frequency transforming unit 11 computes the frequency domain signal for each of the plurality of frequency bands by transforming the speech signal into the frequency domain on a frame-by-frame basis by applying a Hamming window while shifting from one frame to the next by one half of the frame length (step S101). Then, the time-to-frequency transforming unit 11 passes the amplitude component of the frequency domain signal in each frequency band to the noise estimating unit 12, the signal-to-noise ratio computing unit 13, and the enhancing unit 15. Further, the time-to-frequency transforming unit 11 passes the phase component of the frequency domain signal in each frequency band to the frequency-to-time transforming unit 16.

The noise estimating unit 12 estimates the noise component for each frequency band in the current frame by updating, based on the amplitude component in each frequency band in the current frame, the noise model computed for a predetermined number of past frames (step S102). Then, the noise estimating unit 12 stores the updated noise model in a buffer, and passes the noise component in each frequency band to the signal-to-noise ratio computing unit 13 and the enhancing unit 15.

The signal-to-noise ratio computing unit 13 computes SNR(f) for each frequency band (step S103). The signal-to-noise ratio computing unit 13 passes the SNR(f) computed for each frequency band to the gain computing unit 14.

Based on the SNR(f) computed for each frequency band, the gain computing unit 14 selects the frequency band in which the signal component contained in the speech signal is recognizable (step S104). Then, the gain computing unit 14 determines the gain g so that the gain g increases as the average value SNRav of the SNR(f) of the selected frequency band increases (step S105). The gain computing unit 14 passes the gain g to the enhancing unit 15.

The enhancing unit 15 amplifies the amplitude component of the frequency domain signal by multiplying the amplitude component by the gain g over the entire frequency range (step S106). Further, the enhancing unit 15 computes the corrected amplitude component with the noise component suppressed by subtracting the noise component from the amplified amplitude component in each frequency band (step S107). The enhancing unit 15 passes the corrected amplitude component of each frequency band to the frequency-to-time transforming unit 16.

The frequency-to-time transforming unit 16 computes the corrected frequency domain signal by combining the corrected amplitude component with the phase component on a per frequency band basis. Then, the frequency-to-time transforming unit 16 transforms the corrected frequency domain signal into the time domain to obtain the corrected speech signal for the current frame (step S108). The frequency-to-time transforming unit 16 then produces the corrected speech signal by shifting the corrected speech signal for the current frame by one half of the frame length relative to the immediately preceding frame and adding the corrected speech signal for the current frame to the corrected speech signal for the immediately preceding frame (step S109). After that, the speech enhancement apparatus 5 terminates the speech enhancing process.

As has been described above, the speech enhancement apparatus first amplifies the amplitude component of the speech signal over the entire frequency range, and then subtracts the noise component from the amplified amplitude component. In this way, the speech enhancement apparatus can suppress the noise component without excessively suppressing the intended signal component, even when the noise component contained in the speech signal is relatively large. Further, the speech enhancement apparatus can set the appropriate amount of amplification by determining the amount of amplification of the amplitude component based on the frequency band where the signal-to-noise ratio is relatively high.

Next, a speech enhancement apparatus according to a second embodiment will be described. The speech enhancement apparatus according to the second embodiment adjusts the gain for each frequency band based on the SNR(f) of that frequency band.

Figure 8:
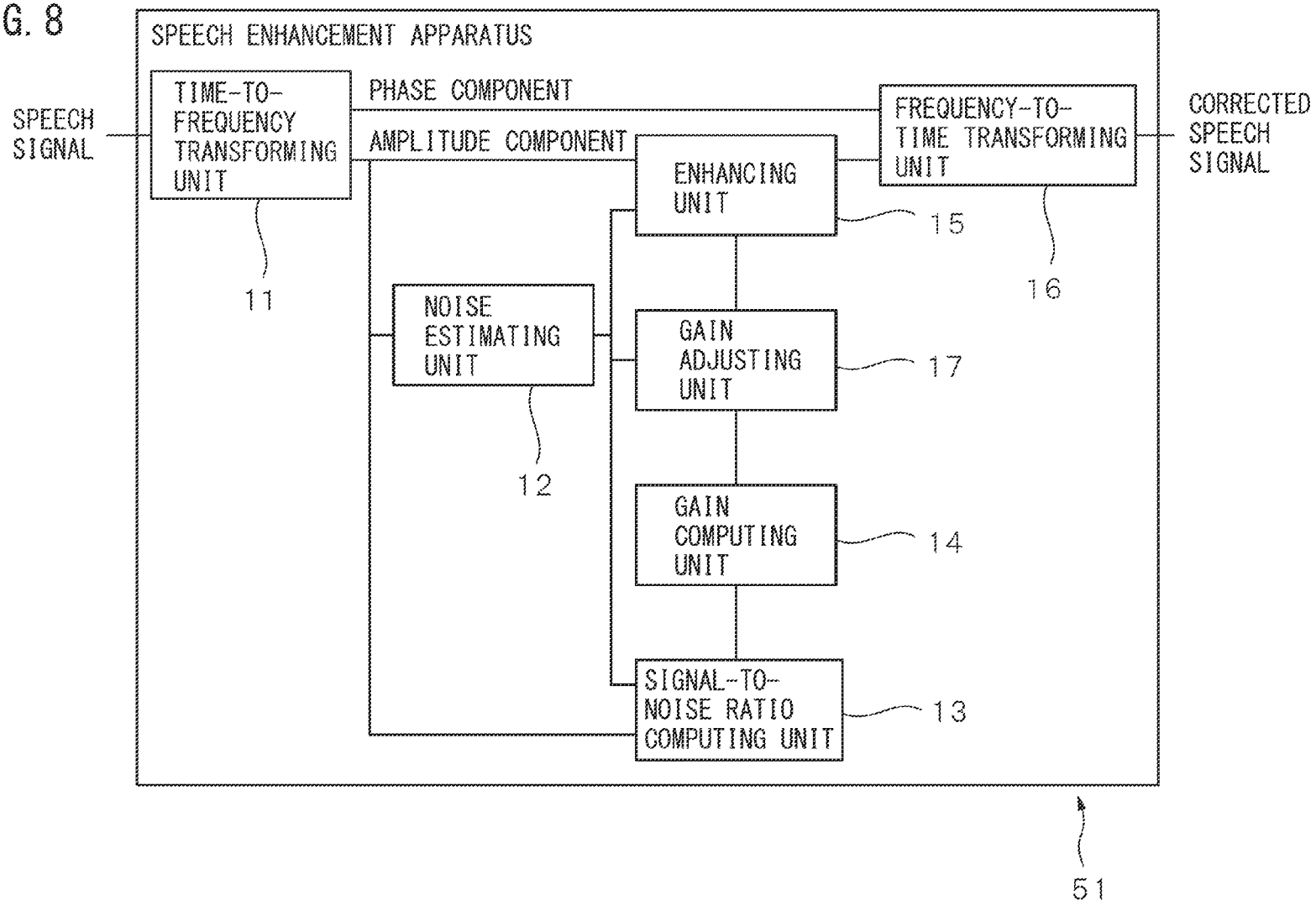
FIG. 8 is a diagram schematically illustrating the configuration of a speech enhancement apparatus according to a second embodiment.

FIG. 8 is a diagram schematically illustrating the configuration of the speech enhancement apparatus 51 according to the second embodiment. The speech enhancement apparatus 51 includes a time-to-frequency transforming unit 11, a noise estimating unit 12, a signal-to-noise ratio computing unit 13, a gain computing unit 14, a gain adjusting unit 17, an enhancing unit 15, and a frequency-to-time transforming unit 16. In FIG. 8, the component elements of the speech enhancement apparatus 51 are designated by the same reference numerals as those used to designate the corresponding component elements of the speech enhancement apparatus 5 illustrated in FIG. 2.

The speech enhancement apparatus 51 of the second embodiment differs from the speech enhancement apparatus 5 of the first embodiment by the inclusion of the gain adjusting unit 17. The following description therefore deals with the gain adjusting unit 17 and its associated parts. For the other component elements of the speech enhancement apparatus 51, refer to the description earlier given of the corresponding component elements of the first embodiment.

The gain adjusting unit 17 receives the SNR(f) of each frequency band from the signal-to-noise ratio computing unit 13 and the gain g from the gain computing unit 14. Then, to prevent the distortion of the speech signal due to excessive enhancement, the gain adjusting unit 17 reduces the gain for the frequency band as the SNR(f) of the frequency band increases.

Figure 9:
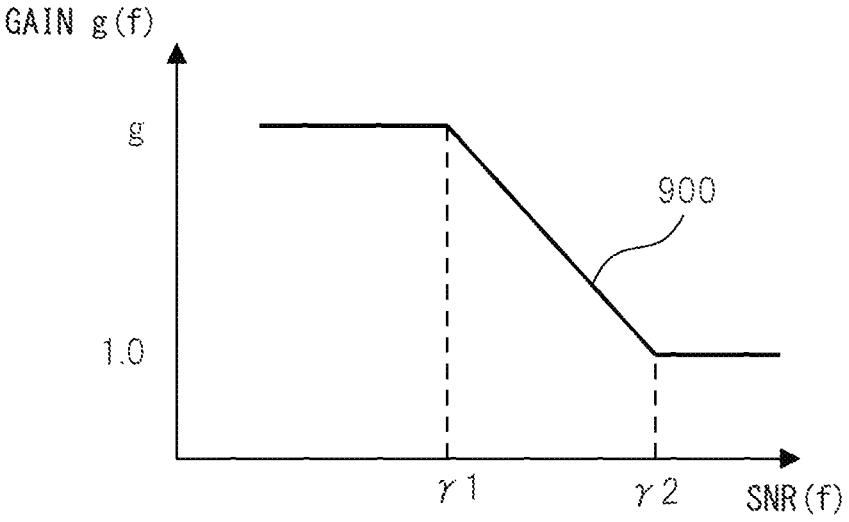
FIG. 9 is a diagram illustrating one example of the relationship between SNR(f) and adjusted gain g(f).

FIG. 9 is a diagram illustrating one example of the relationship between SNR(f) and gain g(f). In FIG. 9, the abscissa represents the average SNR(f) [dB], and the ordinate represents the gain g(f). Graph 900 depicts how the gain g(f) is adjusted as a function of the SNR(f). As depicted by the graph 900, when the SNR(f) is smaller than $\gamma 1$, the gain adjusting unit 17 sets the gain g(f) equal to the gain g determined by the gain computing unit 14. On the other hand, when the SNR(f) is larger than $\gamma 1$ but not larger than $\gamma 2$, the gain adjusting unit 17 reduces the gain g(f) linearly as the SNR(f) increases. More specifically, when $\gamma 1 \leq \mathrm{SNR}(f) < \gamma 2$, the gain g(f) is computed in accordance with the following equation.

$$g(f)=g-(\mathrm{SNR}(f)-\gamma 1)\times(g-1.0)/(\gamma 2-\gamma 1) \quad (6)$$

When the SNR(f) is equal to or larger than $\gamma 2$, the gain adjusting unit 17 sets the gain g(f) to 1.0.

The values $\gamma 1$ and $\gamma 2$ are empirically determined so that the corrected speech signal will not be distorted unnaturally; for example, $\gamma 1=12$ [dB] and $\gamma 2=18$ [dB]. It is preferable to set $\gamma 1$ and $\gamma 2$ larger than the lower limit value $\beta 2$ of SNRav where the gain g is maximum so that the degree of enhancement to be applied to the amplitude component will not become too small.

The gain adjusting unit 17 passes the gain g(f) of each frequency band to the enhancing unit 15.

The enhancing unit 15 amplifies the amplitude component of the frequency domain signal in each frequency band by substituting the gain g(f) of the frequency band for the gain g in equation (4).

Figure 10:
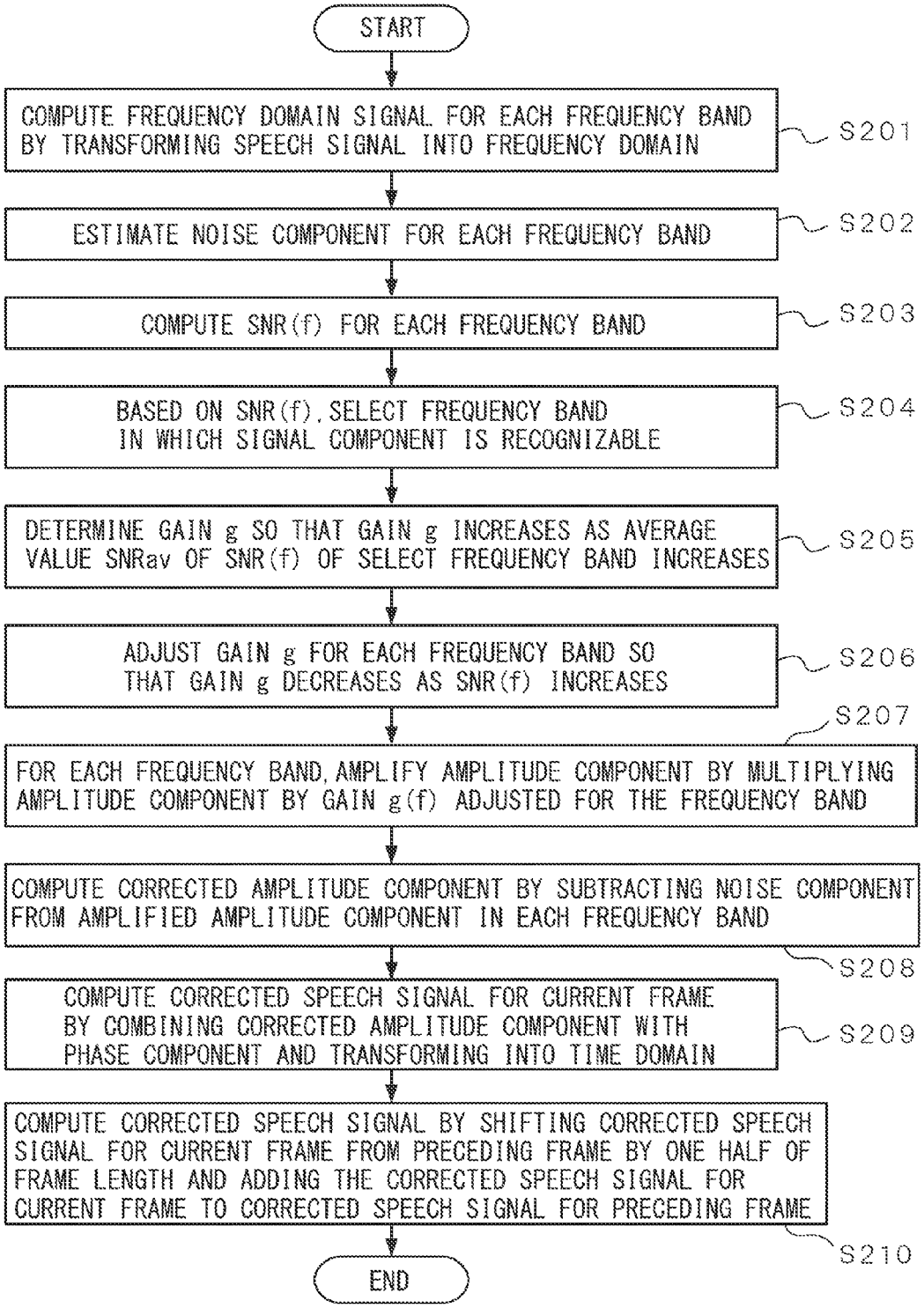
FIG. 10 is an operation flowchart illustrating a speech enhancing process according to the second embodiment.

FIG. 10 is an operation flowchart illustrating the speech enhancing process according to the second embodiment. The speech enhancement apparatus 51 carries out the speech enhancing process on a frame-by-frame basis in accordance with the following operation flowchart. Steps S201 to S205 and S208 to S210 in FIG. 10 correspond to the steps S101 to S105 and S107 to S109 in the speech enhancing process of the first embodiment illustrated in FIG. 7. The following description therefore deals with the process of steps S206 and S207.

When the gain g is computed by the gain computing unit 14, the gain adjusting unit 17 adjusts the gain g for each frequency band so that the gain g decreases as the SNR(f) of the frequency band increases, and thus determines the gain g(f) adjusted for the frequency band (step S206). Then, for each frequency band, the enhancing unit 15 amplifies the amplitude component by multiplying the amplitude component by the gain g(f) adjusted for the frequency band (step S207). After that, the corrected speech signal is generated by using the amplified amplitude component.

According to the second embodiment, to reduce the degree of enhancement for any frequency band whose signal-to-noise ratio is good, the speech enhancement apparatus reduces the gain to a relatively low value for any frequency band whose signal-to-noise ratio is high. In this way, the speech enhancement apparatus can prevent the distortion of the corrected speech signal while suppressing noise.

According to a modified example, the gain computing unit 14 may set the gain g larger as the number of frequency bands whose SNR(f) is not smaller than a predetermined threshold value increases. This serves to further improve the quality of the corrected speech signal, because the speech signal is enhanced to a greater degree as the number of frequency bands containing the signal component increases.

According to another modified example, the enhancing unit 15 may compute the corrected amplitude component for each frequency band by subtracting the noise component from the amplitude component of the original speech signal and then multiplying the remaining component by the gain g. In this case, the enhancing unit 15 can prevent the occurrence of overflow due to multiplication by the gain g, even when the amplitude component of the original speech signal is very large.

The speech enhancement apparatus according to any of the above embodiments or their modified examples can be applied not only to hands-free phones but also to other speech input systems such as mobile telephones or loudspeakers. Further, the speech enhancement apparatus according to any of the above embodiments or their modified examples can also be applied to a speech input system having a plurality of microphones, for example, a videophone system. In this case, the speech enhancement apparatus corrects the speech signal on a microphone-by-microphone basis in accordance with any one of the above embodiments or their modified examples. Alternatively, the speech enhancement apparatus delays the speech signal from one microphone relative to the speech signal from another microphone by a predetermined time, and adds the signals together or subtracts one from the other, thereby producing a synthesized speech signal that enhances or attenuates the speech arriving from a specific direction. Then, the speech enhancement apparatus may perform the speech enhancing process on the synthesized speech signal.

The speech enhancement apparatus according to any of the above embodiments or their modified examples may be incorporated, for example, in a mobile telephone and may be configured to correct the speech signal generated by another apparatus. In this case, the speech signal corrected by the speech enhancement apparatus is reproduced through a speaker built into the device equipped with the speech enhancement apparatus.

A computer program for causing a computer to implement the functions of the various units constituting the speech enhancement apparatus according to any of the above embodiments may be provided in the form recorded on a computer-readable medium such as a magnetic recording medium or an optical recording medium. The term "recording medium" here does not include a carrier wave.

Figure 11:
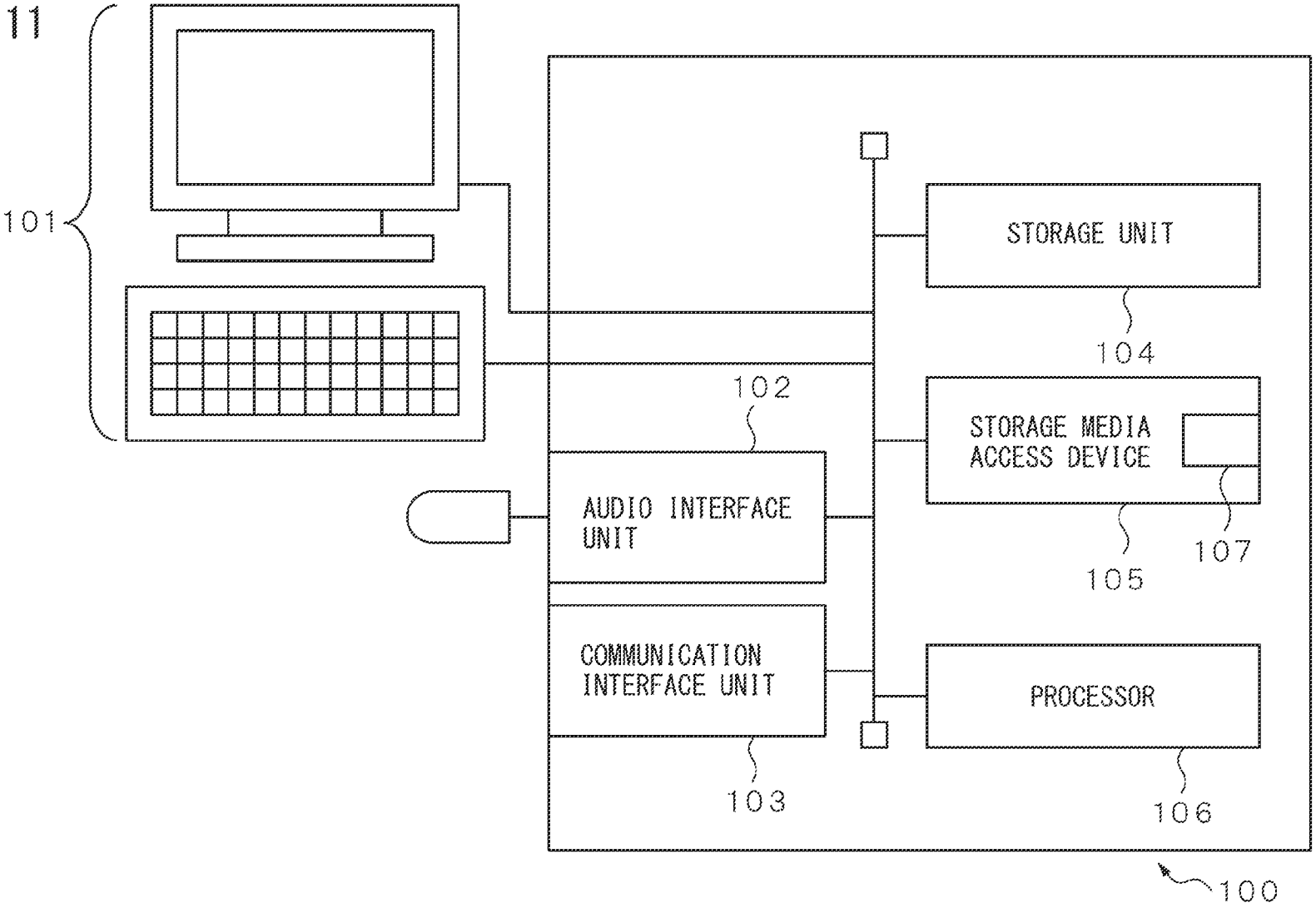
FIG. 11 is a diagram illustrating the configuration of a computer that operates as the speech enhancement apparatus by executing a computer program for implementing the functions of the various units constituting the speech enhancing apparatus according to any one of the above embodiments or their modified examples.

FIG. 11 is a diagram illustrating the configuration of a computer that operates as the speech enhancement apparatus by executing a computer program for implementing the functions of the various units constituting the speech enhancing apparatus according to any one of the above embodiments or their modified examples.

The computer 100 includes a user interface unit 101, an audio interface unit 102, a communication interface unit 103, a storage unit 104, a storage media access device 105, and a processor 106. The processor 106 is connected to the user interface unit 101, the audio interface unit 102, the communication interface unit 103, the storage unit 104, and the storage media access device 105, for example, via a bus.

The user interface unit 101 includes, for example, an input device such as a keyboard and a mouse, and a display device such as a liquid crystal display. Alternatively, the user interface unit 101 may include a device, such as a touch panel display, into which an input device and a display device are integrated. The user interface unit 101 supplies an operation signal to the processor 106 to initiate a speech enhancing process for enhancing a speech signal that is input via the audio interface unit 102, for example, in accordance with a user operation.

The audio interface unit 102 includes an interface circuit for connecting the computer 100 to a speech input device such as a microphone that generates the speech signal. The audio interface unit 102 acquires the speech signal from the speech input device and passes the speech signal to the processor 106.

The communication interface unit 103 includes a communication interface for connecting the computer 100 to a communication network conforming to a communication standard such as the Ethernet (registered trademark), and a control circuit for the communication interface. The communication interface unit 103 receives a data stream containing the corrected speech signal from the processor 106, and outputs the data stream onto the communication network for transmission to another apparatus. Further, the communication interface unit 103 may acquire a data stream containing a speech signal from another apparatus connected to the communication network, and may pass the data stream to the processor 106.

The storage unit 104 includes, for example, a readable/writable semiconductor memory and a read-only semiconductor memory. The storage unit 104 stores a computer program for implementing the speech enhancing process, and the data generated as a result of or during the execution of the program.

The storage media access device 105 is a device that accesses a storage medium 107 such as a magnetic disk, a semiconductor memory card, or an optical storage medium. The storage media access device 105 accesses the storage medium 107 to read out, for example, the computer program for speech enhancement to be executed on the processor 106, and passes the readout computer program to the processor 106.

The processor 106 executes the computer program for speech enhancement according to any one of the above embodiments or their modified examples and thereby corrects the speech signal received via the audio interface unit 102 or via the communication interface unit 103. The processor 106 then stores the corrected speech signal in the storage unit 104, or transmits the corrected speech signal to another apparatus via the communication interface unit 103.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority and inferiority of the invention. Although the embodiments of the present invention have been described in detail, it should be understood that the various changes, substitutions, and alterations could be made hereto without departing from the spirit and scope of the invention.

What is claimed is:

1. A speech enhancement apparatus comprising:

a processor configured to:

compute a frequency domain signal for each of a plurality of frequency bands by transforming a speech signal containing a signal component and a noise component into a frequency domain;

estimate the noise component based on the frequency domain signal for each frequency band;

compute, for each frequency band, a signal-to-noise ratio representing the ratio of the signal component to the noise component;

select each frequency band whose computed signal-to-noise ratio is not smaller than a predetermined threshold value among the plurality of frequency bands;

determine a gain indicating the degree of enhancement to be applied to the speech signal in accordance with the signal-to-noise ratio of the selected frequency band;

amplify an amplitude component of the frequency domain signal in each frequency band in accordance with the gain, and which corrects the amplitude component of the frequency domain signal by subtracting the noise component from the amplitude component in each frequency band; and compute a corrected speech signal by transforming the frequency domain signal having the corrected amplitude component in each frequency band into a time domain, wherein the determining of the gain sets the gain larger as the number of selected frequency bands is larger.

2. The speech enhancement apparatus according to claim 1, wherein the determining the gain sets the gain larger as an average value of the signal-to-noise ratio of the selected frequency band is higher.

3. The speech enhancement apparatus according to claim 1, wherein the processor is further configured to adjust the gain for each of the plurality of frequency bands so that the gain decreases as the signal-to-noise ratio of the frequency band increases, and wherein for each of the plurality of frequency bands, the amplifying the amplitude component amplifies the amplitude component in accordance with the gain adjusted for the frequency band.

4. The speech enhancement apparatus according to claim 3, wherein when an average value of the signal-to-noise ratio of the selected frequency band is higher than or equal to a predetermined value, the gain computing unit sets the gain to a first value, and for any frequency band in which the signal-to-noise ratio is higher than the predetermined value, the adjusting the gain for each of the plurality of frequency bands adjusts the gain so that the gain decreases as the signal-to-noise ratio of the frequency band increases.

5. The speech enhancement apparatus according to claim 1, wherein for each of the plurality of frequency bands, the amplifying the amplitude component computes the corrected amplitude component by subtracting the noise component from the amplified amplitude component.

6. A speech enhancement method comprising:

computing a frequency domain signal for each of a plurality of frequency bands by transforming a speech signal containing a signal component and a noise component into a frequency domain;

estimating the noise component based on the frequency domain signal for each frequency band;

computing, for each frequency band, a signal-to-noise ratio representing the ratio of the signal component to the noise component;

selecting each frequency band whose computed signal-to-noise ratio is not smaller than a predetermined threshold value among the plurality of frequency bands;

determining a gain indicating the degree of enhancement to be applied to the speech signal in accordance with the signal-to-noise ratio of the selected frequency band;

amplifying an amplitude component of the frequency domain signal in each frequency band in accordance with the gain, and correcting the amplitude component of the frequency domain signal by subtracting the noise component from the amplitude component in each frequency band; and computing a corrected speech signal by transforming the frequency domain signal having the corrected amplitude component in each frequency band into a time domain, wherein the determining of the gain sets the gain lamer as the number of selected frequency bands is lamer.

7. The speech enhancement method according to claim 6, wherein the determining the gain sets the gain larger as an average value of the signal-to-noise ratio of the selected frequency band is higher.

8. The speech enhancement method according to claim 6, further comprising adjusting the gain for each of the plurality of frequency bands so that the gain decreases as the signal-to-noise ratio of the frequency band increases, and wherein for each of the plurality of frequency bands, the amplifying the amplitude component amplifies the amplitude component in accordance with the gain adjusted for the frequency band.

9. The speech enhancement method according to claim 8, wherein when an average value of the signal-to-noise ratio of the selected frequency band is higher than or equal to a predetermined value, the determining the gain sets the gain to a first value, and for any frequency band in which the signal-to-noise ratio is higher than the predetermined value, the adjusting the gain for each of the plurality of frequency bands adjusts the gain so that the gain decreases as the signal-to-noise ratio of the frequency band increases.

10. The speech enhancement method according to claim 6, wherein for each of the plurality of frequency bands, the amplifying the amplitude component computes the corrected amplitude component by subtracting the noise component from the amplified amplitude component.

11. A non-transitory computer-readable recording medium having recorded thereon a speech enhancement computer program that causes a computer to execute a process comprising:

computing a frequency domain signal for each of a plurality of frequency bands by transforming a speech signal containing a signal component and a noise component into a frequency domain;

estimating the noise component based on the frequency domain signal for each frequency band;

computing, for each frequency band, a signal-to-noise ratio representing the ratio of the signal component to the noise component;

selecting each frequency band whose computed signal-to-noise ratio is not smaller than a predetermined threshold value among the plurality of frequency bands;

determining a gain indicating the degree of enhancement to be applied to the speech signal in accordance with the signal-to-noise ratio of the selected frequency band;

amplifying an amplitude component of the frequency domain signal in each frequency band in accordance with the gain, and correcting the amplitude component of the frequency domain signal by subtracting the noise component from the amplitude component in each frequency band; and computing a corrected speech signal by transforming the frequency domain signal having the corrected amplitude component in each frequency band into a time domain, wherein the determining of the gain sets the gain larger as the number of selected frequency bands is lamer.

* * * * *